US005814753A

United States Patent [19]

Rieger

[11] Patent Number: 5,814,753

[45] Date of Patent: Sep. 29, 1998

[54] DEVICE FOR THE NONLETHAL COMBATING OF AIRCRAFT

[75] Inventor: Ulrich Rieger, Feldkirchen, Germany

[73] Assignee: Daimler-Benz Aerospace AG, München, Germany

[21] Appl. No.: 459,696

[22] Filed: Jun. 2, 1995

[30] Foreign Application Priority Data

Jun. 6, 1994 [DE] Germany ..... 44 19 788.8

[51] Int. Cl.[6] ..... F42B 12/36; F41H 13/00

[52] U.S. Cl. ..... 89/1.11; 102/293; 102/502; 102/504; 244/110 F

[58] Field of Search ..... 89/1.11, 1.34; 102/293, 393, 502, 504, 505; 244/110 C, 110 F; 342/12

[56] References Cited

U.S. PATENT DOCUMENTS

| | | | |
|---|---|---|---|
| 1,171,152 | 2/1916 | Steinmetz | 89/1.11 |
| 1,309,530 | 7/1919 | Lamberson | 102/504 |
| 1,312,764 | 8/1919 | Straub | 102/504 |
| 1,488,182 | 3/1924 | Whelton | 102/504 |
| 1,744,233 | 1/1930 | Locori | 102/504 |
| 1,757,788 | 5/1930 | West | 102/504 |
| 1,759,912 | 5/1930 | Mount | 102/504 |
| 2,283,065 | 5/1942 | Hunter | 102/504 |
| 2,285,789 | 6/1942 | Woolley | 89/1.11 |
| 2,322,624 | 6/1943 | Forbes | 102/504 |
| 2,339,921 | 1/1944 | Fraser | 102/504 |
| 2,360,096 | 10/1944 | Aydelotte | 102/504 |
| 2,368,587 | 1/1945 | Wise | 102/504 |
| 2,373,364 | 4/1945 | Wellcome | 102/504 |
| 2,374,261 | 4/1945 | Ames | 89/1.11 |

FOREIGN PATENT DOCUMENTS

| | | |
|---|---|---|
| 858 712 | 12/1940 | France . |
| C-318 027 | 1/1920 | Germany . |
| B-12 09 838 | 1/1966 | Germany . |
| 33 27 043 A1 | 2/1985 | Germany . |
| 34 37 594 A1 | 4/1986 | Germany . |
| A-38 00 879 | 9/1988 | Germany . |
| 37 22 420 A1 | 1/1989 | Germany . |
| 37 35 426 A1 | 5/1989 | Germany . |
| A-210 356 | 7/1940 | Switzerland . |
| 100 753 | 10/1917 | United Kingdom . |

OTHER PUBLICATIONS

McGraw–Hill Dictionary of Scientific and Technical Terms, Third Edition, McGraw–Hill Bookm Company, New York. p. 518.

Mechanics of Materials, Second Edition, Prentice–Hall, Inc., New Jersey. p. 37.

*Primary Examiner*—Michael J. Carone
*Assistant Examiner*—Theresa M. Wesson
*Attorney, Agent, or Firm*—McGlew and Tuttle

[57] ABSTRACT

The present invention pertains to a device with nonlethal interference active bodies for combating aircraft, which violate or do not heed flight bans, etc., and can be forced to land due to vibrations and interferences in the air current on the aerodynamic surfaces. A series of embodiments are described and depicted in the figures of the drawing.

20 Claims, 4 Drawing Sheets

DEVICE FOR THE NONLETHAL COMBATING OF AIRCRAFT

FIELD OF THE INVENTION

The present invention pertains to a device for the nonlethal combating of aircraft using a flight-mechanical restricting structure which is brought into active proximity of the aircraft using a transporting structure the flight-mechanical restriction structure scattering interference active bodies which change or degrade after a predetermined period of time.

BACKGROUND OF THE INVENTION

The last few years have shown that there is an increasing occurrence of flight decrees and bans (restrictions on flight) not being obeyed and heeded and of national powers not being in a position to enforce such bans, as it were, "with peaceful means." Demands, which are sent to the aircraft pilot by radio or by other signals, are not heeded by the pilot, and a lethal combat is not ordered for humanitarian reasons. However, in the past, a series of methodical shooting downs has occurred, such as the shooting down of a jumbo jet in Kamchatka, the shooting down of the airbus and helicopters in Iraq, or the many flight violations in Yugoslavia.

At the present time, the state of the art does not have any safe means of forcing unauthorized flying aircraft to land, without endangering the lives of the pilot and innocent passengers. It became known from the last world war that aircraft were able to be protected against radar detection by means of dropping a great deal of tinfoil or aluminum foil strips or similar interference bodies to the extent that exact detection measurements were impossible or were at least, however, greatly interfered with.

Infrared active bodies, which are droppable, flexible, inflatable and take shape, but which are not in a position to force an aircraft to land, are known from U.S. Pat. No. 5,249,527.

A projectile for defense against helicopters, which consists of a pair of uneven bodies connected by means of a wire, which pair should become entangled in a rotor blade, is known from German Patent DE 34 37 594 A1. In this case, a nonlethal combating of aircraft is, at best, perhaps possible; however, mainly it results in the crashing of the aircraft.

A projectile for combating a helicopter, which is launched approximately in alignment with the direction of the aircraft and is to surround this helicopter with a net and force it to crash, is known from DE 37 22 420 A1.

A projectile with a deployable element, which is to block air spaces for missiles, is also known from DE 37 35 426 A1. However, all of these prior-art means do not rule out a lethal consequence of the combat; on the contrary, they are almost exclusively designed for such combat.

However, an intercept device for flying objects, in which activatable, aerodynamic resistance bodies are incorporated, which completely or partially surround the flying object and self-destruct themselves after a predetermined time by means of an integrated device, is known from the applicant's patent No. DE 44 09 424 (corresponding to U.S. application Ser. No. 08/407,107). Of course, this device is relatively expensive, especially due to the integrated self-destruct device.

SUMMARY AND OBJECTS OF THE INVENTION

The primary object of the present invention is to create an active means of the type mentioned above, which is in a position to force unauthorized aircraft to change course or to land safely, without the lives of the passengers thereby being endangered.

According to the invention, a device for the nonlethal combating of aircraft is provided including means for generating a flight-mechanical restriction, transporting means for carrying the restriction into the active proximity of the aircraft; and means for scattering interference active bodies, which change or completely disintegrate after a predetermined period of time. The interference active bodies are formed of an elastic material and are provided in a flat, space-saving shape by applying force to form a packing configuration, said active bodies including structure for changing the active body from a space-saving shape into a spatially expanded shape, provided a release and suspension configuration. The transporting means deploys the active bodies to a region for surrounding the aircraft to form a cloud of interference active bodies for positioning the interference active bodies in the proximity of a stagnation point of aerodynamic surfaces of the plane in a surprisingly simple manner. Exemplary embodiments are explained in the description below.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DETAILED DESCRIPTION OF THE PREFERRED EMBODIMENTS

Figure 1:
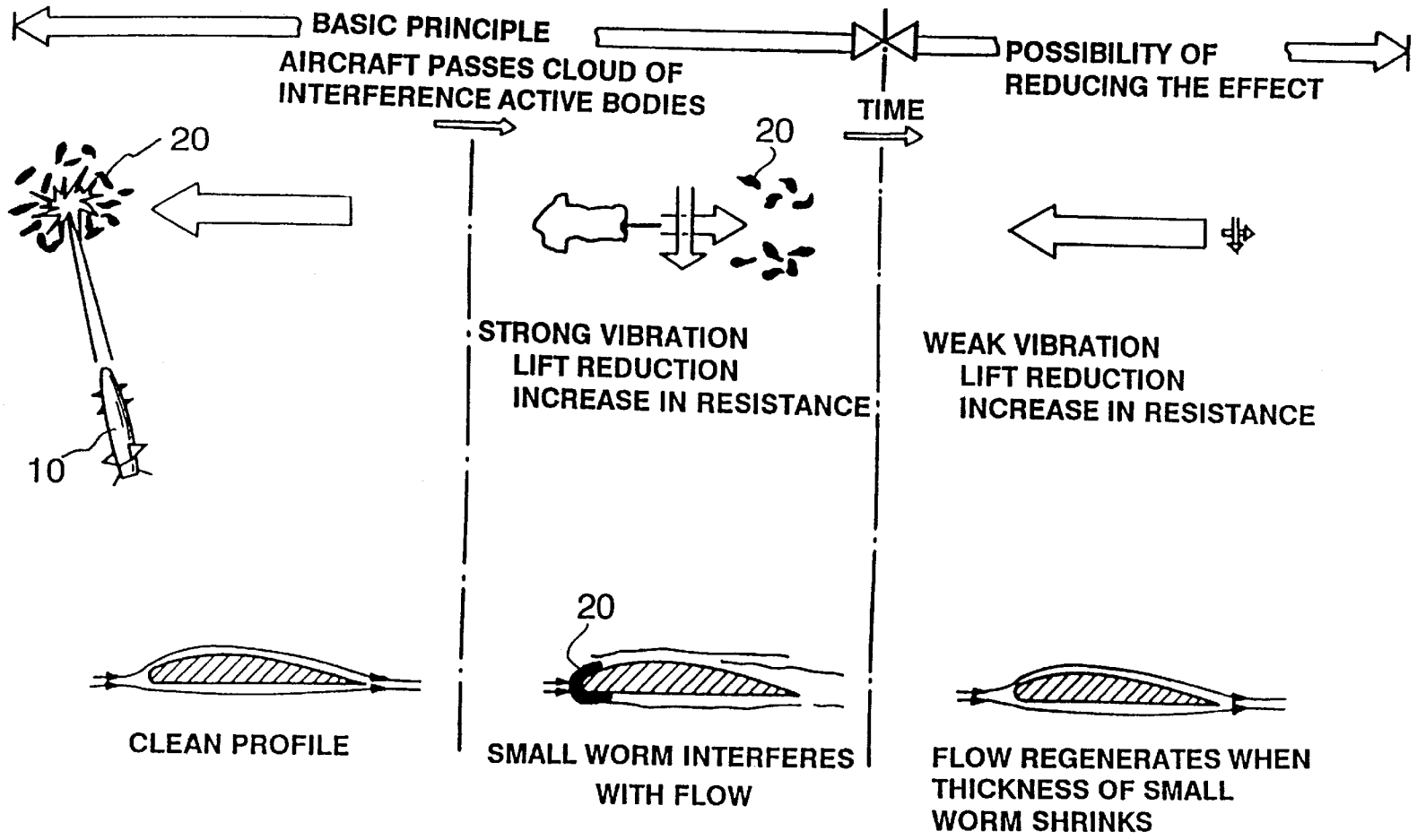
FIG. 1 is a schematic view of the individual phases regarding the launching and action of the proposed system.

Referring to the drawings in particular, FIG. 1 shows to the left in FIG. 1 a first phase of the nonlethal combating of aircraft of all types and sizes. The other phases are shown to the right (time progressing from left to right). Transportation means is provided in the form of a target-searching and fully active homing missile 10, which is provided with a velocity-time fuse or a radio-proximity fuse and which is compactly filled with interference active bodies 20. The transportation means 10 brings these bodies 20 into the proximity of the aircraft to be forced to land and to explode the missile 10, so that the aircraft in question is surrounded by a dense cloud of interference active bodies 20. As a result of the planes flight trajectory and possibly also because of the force of the "explosion" of the carrier (transportation means 10) of the interference active bodies 20, these bodies 20 are forced into the proximity of the stagnation point of the aerodynamic surfaces (this phase shown in the center in FIG. 1) and thus generate interferences in the air current in the most aerodynamically sensitive area. This leads to a considerable impairment of the flight behavior and causes vibrations, increases in resistance and lift losses. This inevitably leads to a restricted maneuverability, a loss of flight range and finally to the uncertainty of the pilot.

In order to now permit the aircraft a trouble-free, unrestricted landing, the interference active bodies must be designed such that the effect of their interference is or will be reduced (this phase is shown to the right in FIG. 1) in the landing approach to the extent that the landing can be made with absolute certainty. To a great extent, this will already be achievable alone due to the reduction in the cruising speed to the landing speed, since many of the interference active bodies, for example, will fall off by themselves.

Figure 2A:
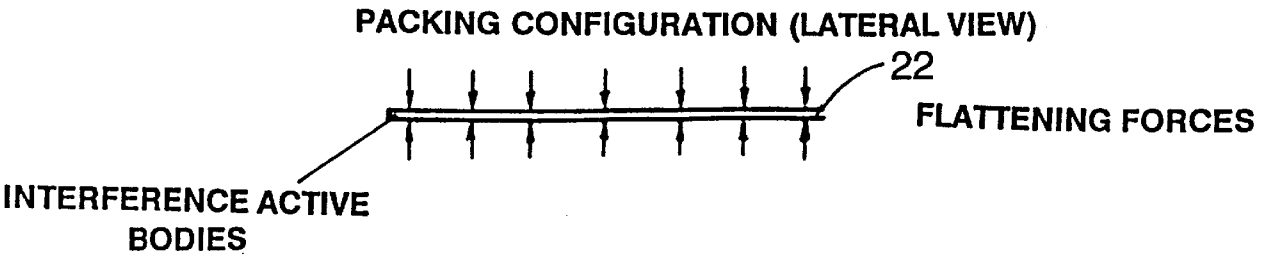
FIG. 2 is a schematic view of an embodiment of the proposed active bodies made of elastic material.
Figure 2B:
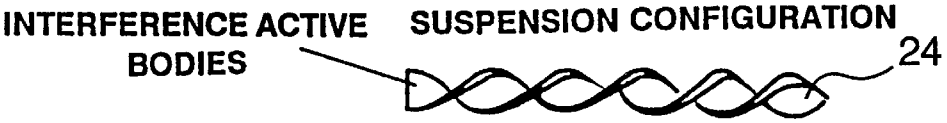
Figure 2C:
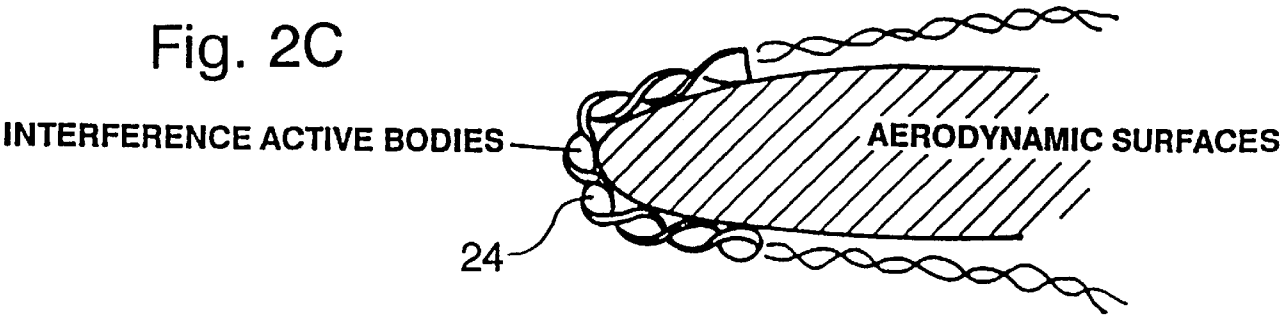
Figure 3A:
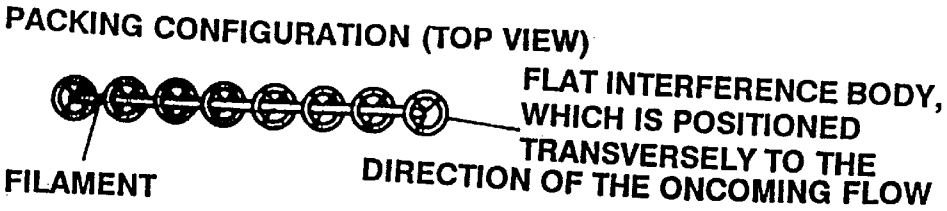
FIG. 3 is a schematic view of another embodiment of the interference bodies.
Figure 3B:
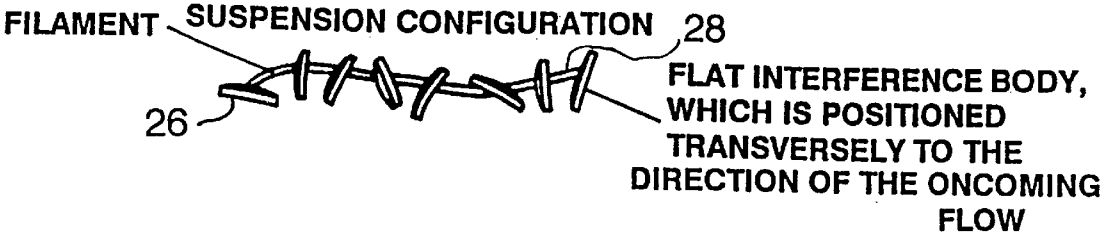
Figure 3C:
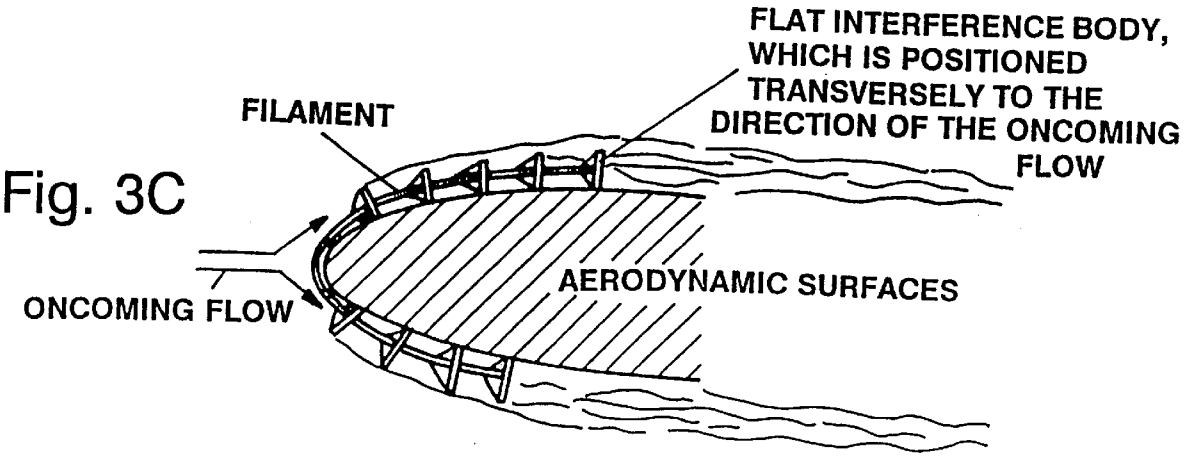
Figure 4A:
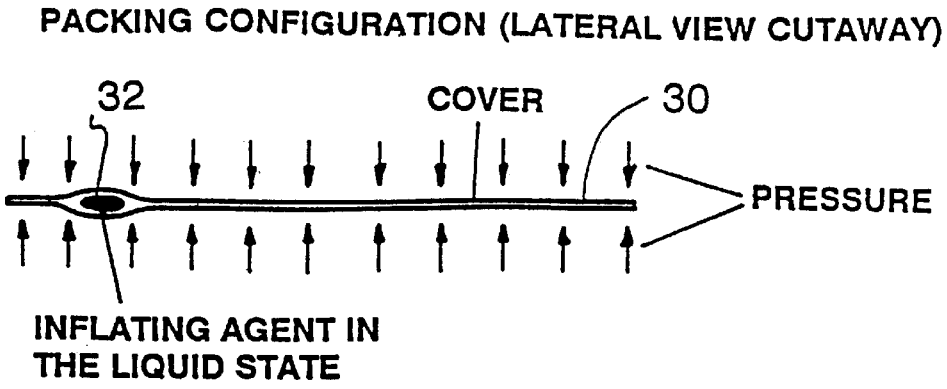
FIG. 4 is a schematic view of a third, especially space-saving embodiment of the interference bodies.
Figure 4B:
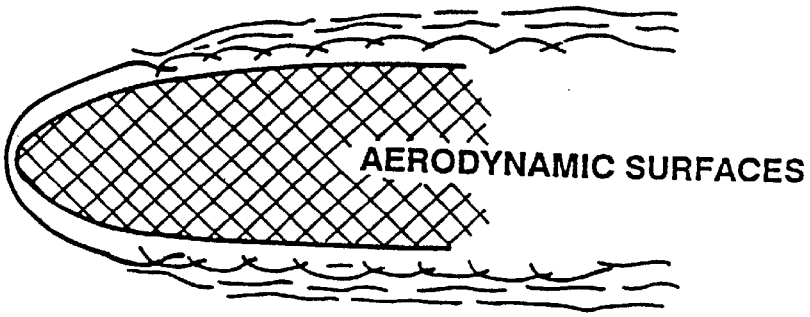
Figure 4C:
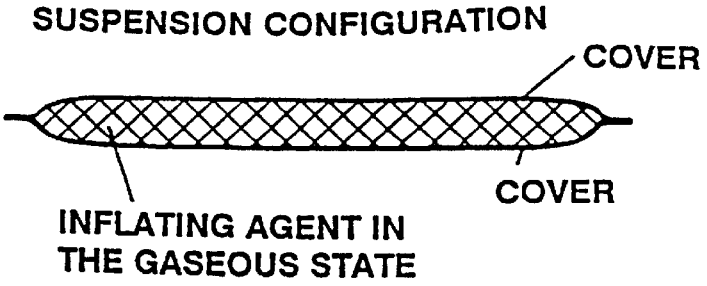

The individual interference active bodies 20 can be produced in a variety of ways as to their shape, design and size. They are preferably to have a length of 5 to about 20 cm and a thickness of a few tenths of a millimeter to about 2 to 3 centimeters (sheet bonds). Various embodiments are illustrated in FIGS. 2 through 4 of the drawing. The exemplary embodiment of the interference active bodies 20 according to FIG. 2 is comprised of elastic material or spring material, such as an elastic steel band (spring steel-leafspring like). The band is forced into a flat shape 22 by means of the application of force during the so-called packing process. After ejection, that is, in the state of suspension, the interference active bodies 20 assume a distinctly spatially expanded shape 24, to adapt to the contour of the aerodynamic surfaces and to continue to suspend; as FIG. 2 illustrates, the narrow, elastic steel band is therefore twisted in its longitudinal direction, and individual partial surfaces are expanded.

FIG. 3 shows another version. In this case, the interference active bodies 20 are comprised of chains of small, essentially flat bodies 26 made of metal or plastic, which are connected to one another by means of a filament 28, and which are designed such that they are placed transversely to the current in the case of oncoming flow, for example, as balls or correspondingly fixed disks, small polygonal plates, etc.

The exemplary embodiment illustrated in FIG. 4 consists of oblong, flat, inflatable covers 30, which inflate when launched. For this purpose, each cover 30 in an exemplary embodiment contains an inflating agent 32, which is liquid under, for example, high pressure, but is gaseous under atmospheric or dynamic pressure (the so-called butane lighter principle). These interference active bodies 20 are kept under high pressure for transportation. The bodies 20 expand under atmospheric pressure, when deployed.

In another exemplary embodiment, the interference active bodies 20 are comprised of foam and are first generated when they are launched. A certain storage supply of foam-forming material is to be transported here together with a generator, for example, a string-forming mixing and chopping means for the formation of the interference active bodies. These bodies 20 are preferably stretched out long, but also ring-shaped, chain-shaped, with or without barbs, projections or striking surfaces, etc.

However, the various interference active bodies 20 formed of foam are designed such that they again assume a flat shape by themselves after a certain time or they fall off or disintegrate. It is hereby achieved that the interference effect is at least reduced so that a safe, essentially optimal landing is guaranteed. In this regard, it is conceivable, among other things, that the interference active bodies 20 again assume a flat shape or disintegrate due to radiation from outside. Active bodies, which consist partly or entirely of a material that disintegrates due to radiation with laser light, microwaves, etc., are to be mentioned as an example of this. This embodiment has the advantage that the restriction of the aircraft can be immediately lifted, when it is apparent that it is following instructions.

While specific embodiments of the invention have been shown and described in detail to illustrate the application of the principles of the invention, it will be understood that the invention may be embodied otherwise without departing from such principles.

What is claimed is:

1. A device for the nonlethal combating of aircraft, comprising:

nonlethal flight-mechanical restriction means including a plurality of small interference active bodies formed of elastic material for deforming upon the application of a force and regaining substantially completely its original dimensions upon removal of the force to substantially avoid damage to the aircraft upon undergoing a force of impact upon collision of the aircraft with the active bodies; and transporting means for bringing said flight-mechanical restriction means into an active proximity of the aircraft and for scattering said interference active bodies at said active proximity of the aircraft, said interference active bodies including means for changing shape between a flat space-saving shape, achieved by applying force for positioning the interference active bodies in a packing configuration, and a spatially expanded shape in a release and suspension configuration, said transporting means deploying said interference active bodies to scatter said active bodies to form a cloud-like structure positioned in a proximity of a stagnation point of aerodynamic surfaces of the aircraft.

2. A device according to claim 1, wherein said interference active bodies are formed of a chain of small elements, said elements being one of flat, round, square and tooth material elements, said elements being provided as a chain connected to one another by means of a filament, said elements including transverse to flow orientation means for positioning said elements completely or almost transversely to a current in case of oncoming flow, upon being positioned in said proximity of the stagnation point of the aerodynamic surfaces of the aircraft.

3. A device according to claim 1, wherein said interference active bodies are formed in oblong structure which is inflatable and flexible, said structure including a dimensionally stable cover and one or more inflating agents positioned within said cover.

4. A device according to claim 3, wherein said inflating agent is formed of a material which is liquid under slightly high pressure and which converts into a gaseous state under atmospheric or dynamic pressure.

5. A device according to claim 1, wherein said interference active bodies are formed of a foamed mass.

6. A device according to claim 1, wherein said interference bodies are formed of narrow, elastic bands which are twisted in a longitudinal direction to form individual partial surfaces which are expanded.

7. A device according to claim 1, wherein said interference bodies include means for one of disintegrating, degenerating or deforming said interference bodies into a form which provides a minimal interference with the aircraft, after a predetermined period of time.

8. A device for the nonlethal combating of aircraft, comprising:

nonlethal flight-mechanical restriction means including a plurality of small interference active bodies formed of springy material, said nonlethal flight-mechanical restriction means for changing shape between a substantially flat space-saving shape, achieved by applying force for deforming the interference active bodies for positioning the interference active bodies in a packing configuration, and a spatially expanded shape upon removing the applied force in a release and suspension configuration, said spatially expanded shape defining aerodynamic surface means in said for generating interferences in an air current passing over the active bodies; and transporting means for bringing said nonlethal flight-mechanical restriction means into an active proximity of the aircraft and for scattering said interference active bodies at said active proximity of the aircraft, said transport means holding said interference active bodies in said space-saving shape in said packing configuration, and deploying said interference active bodies in said spatially expanded shape by removing the applied force to provide said release and suspension configuration, said transporting means for scattering said active bodies to form a cloud-like structure positioned in a proximity of a stagnation point of aerodynamic surfaces of the aircraft.

9. A device according to claim 8, wherein said interference active bodies are formed of a chain of small elements, said elements being one of flat, round, square and tooth material elements, said elements being provided as a chain connected to one another by means of a filament, said elements including transverse to flow orientation means for positioning said elements completely or almost transversely to a current in case of oncoming flow, upon being positioned in said proximity of the stagnation point of the aerodynamic surfaces of the aircraft.

10. A device according to claim 8, wherein said interference active bodies are formed in oblong structure which is inflatable and flexible, said structure including a dimensionally stable cover and one or more inflating agents positioned within said cover.

11. A device according to claim 10, wherein said inflating agent is formed of a material which is liquid under slightly high pressure and which converts into a gaseous state under atmospheric or dynamic pressure.

12. A device according to claim 8, wherein said interference active bodies are formed of a foamed mass.

13. A device according to claim 8, wherein said interference bodies are formed of narrow, elastic bands which are twisted in a longitudinal direction to form individual partial surfaces which are expanded.

14. A device according to claim 8, wherein said interference bodies include means for one of disintegrating, degenerating or deforming said interference bodies into a form which provides a minimal interference with the aircraft, after a predetermined period of time.

15. A device for the nonlethal combating of aircraft, comprising:

nonlethal flight-mechanical restriction means including a plurality of small interference active bodies, each of said active bodies being formed of material for deforming upon the application of a force and regaining substantially completely its original dimensions upon removal of the force to substantially avoid damage to the aircraft upon undergoing a force of impact upon collision of the aircraft with the active bodies, said interference active bodies defining elastic material means for changing shape between a substantially flat space-saving shape, achieved by applying force for deforming the interference active bodies for positioning the interference active bodies in a packing configuration, and a spatially expanded shape upon removing the applied force in a release and suspension configuration, said active bodies having aerodynamic surface means in said expanded shape for generating interferences in an air current passing over the active bodies; and transporting means for bringing said nonlethal flight-mechanical restriction means into an active proximity of the aircraft and for scattering said interference active bodies at said active proximity of the aircraft, said transport means holding said interference active bodies in said space-saving shape in said packing configuration, and deploying said interference active bodies in said spatially expanded shape by removing the applied force to provide said release and suspension configuration, said transporting means for scattering said active bodies to form a cloud-like structure positioned in a proximity of a stagnation point of aerodynamic surfaces of the aircraft.

16. A device according to claim 15, wherein said interference active bodies are formed of a chain of small elements, said elements being one of flat, round, square and tooth material elements, said elements being provided as a chain connected to one another by means of a filament, said elements including transverse to flow orientation means for positioning said elements completely or almost transversely to a current in case of oncoming flow, upon being positioned in said proximity of the stagnation point of the aerodynamic surfaces of the aircraft.

17. A device according to claim 15, wherein said interference active bodies are formed in oblong structure which is inflatable and flexible, said structure including a dimensionally stable cover and one or more inflating agents positioned within said cover.

18. A device according to claim 17, wherein said inflating agent is formed of a material which is liquid under slightly high pressure and which converts into a gaseous state under atmospheric or dynamic pressure.

19. A device according to claim 15, wherein said interference bodies are formed of narrow, elastic bands which are twisted in a longitudinal direction to form individual partial surfaces which are expanded.

20. A device according to claim 15, wherein said interference bodies include means for one of disintegrating, degenerating or deforming said interference bodies into a form which provides a minimal interference with the aircraft, after a predetermined period of time.

* * * * *